United States Patent [19]

Livingston et al.

[11] Patent Number: 4,802,344

[45] Date of Patent: Feb. 7, 1989

[54] PORTABLE COOLER FOR BEVERAGE KEGS

[76] Inventors: Mark L. Livingston, 58 W. 650 North, Clearfield, Utah 84015; Michael Babcock, 1234 W. 1350 South, Syracuse, Utah 84041

[21] Appl. No.: 183,364

[22] Filed: Apr. 12, 1988

Related U.S. Application Data

[63] Continuation of Ser. No. 69,771, Jul. 6, 1987, abandoned.

[51] Int. Cl.[4] ..... F25D 3/08

[52] U.S. Cl. ..... 62/372; 62/400; 62/457

[58] Field of Search ..... 62/372, 400, 457; 206/2; 220/902, 903

[56] References Cited

U.S. PATENT DOCUMENTS

| | | | |
|---|---|---|---|
| 3,443,397 | 5/1969 | Donovan et al. | 62/457 X |
| 3,614,875 | 10/1971 | McCallum | 62/400 X |
| 4,042,142 | 8/1977 | Ruano | 62/372 X |
| 4,483,157 | 11/1984 | Human | 62/400 |
| 4,537,313 | 8/1985 | Workman | 62/372 X |
| 4,633,678 | 1/1987 | Lea et al. | 62/400 X |

*Primary Examiner*—Lloyd L. King

*Attorney, Agent, or Firm*—Hubbard, Thurman, Turner & Tucker

[57] ABSTRACT

A thermally insulated cooler for enclosing a beverage keg having a pre-chilled beverage temperature to be maintained. The cooler is of a soft sided composition cylindrical is shape having a permanently closed bottom end and a removable lid zippered at the other end for affording access to the storage compartment. A zippered access opening centrally located in the lid enables a dispensing tap connected to the keg to extend outward thereof without exposing the key to ambient temperatures. A strap extending longitudinally on opposite sides and across the bottom end enables the cooler with keg in place to be conveniently carried by hand.

5 Claims, 2 Drawing Sheets

PORTABLE COOLER FOR BEVERAGE KEGS

This application is a continuation of application Ser. No. 069,771, filed July 6, 1987, now abandoned.

TECHNICAL FIELD

The field of art to which the inventon relates comprises the art of portable insulated containers for providing thermal protection to prepared food products.

BACKGROUND OF THE INVENTION

Portable type insulating containers for maintaining temperature of prepared food products are widely available in a variety of different shapes and sizes. Termed "coolers" where utilized for outdoor activites such as picnics, they are manufactured either of a rigid composition such as styrofoam in the chest type or of an insulated soft side composition in a bag or slip-over configuration. In general, such products are adapted to receive the prepared food products and preserve their temperatures for on the order of about 6–8 hours. For maintaining pre-chilled conditions of the food product, it is common to place ice in the food compartment to enhance and prolong the thermal benefits thereof.

For quantity storage and shipment of consumer beverages such as typically supplied to commercial establishments for soft drinks and beer, it is common to package the beverage in a cask or keg. By means of an outlet connection communicating inward of the keg, the beverage contents can be selectively dispensed in desired quantities as by the glass. Typically, at least the beverage contents have been previously chilled and it is desirable to maintain the chill temperature without the benefit of a refrigeration source. Such kegs can likewise be acquired by the general public for use for example, at a remote site outdoor event such as a picnic where it is intended to dispense the beverage by the glass. It is desirable under the circumstances to maintain the chill temperature for as long as possible either for taste or to preserve the quantity of the product. Indeed, draft beer purchased in keg quantities represents a considerable cost savings as compared to cans or bottles and must be maintained chilled in order to preserve its quality.

While the need to thermally insulate beverage kegs has been recognized, thermal insulation which has been available for that purpose has not been entirely satisfactory. Typically, available insulators have either been constructed as a jacket slipover or as an insulating wrap. Both, however, leave portions of the keg exposed in that neither provides a complete enclosure in order to more completely thermally insulate the keg. Furthermore, neither is able to receive and contain ice to enhance and prolong the provided thermal benefits and both, when in place can render the keg difficult to transport by hand.

SUMMARY OF THE INVENTION

This invention relates to a cooler apparatus for thermally insulating beverage kegs. More specifically, the invention relates to a soft side keg cooler for maintaining chilled beverage temperatures which not only is able to enclose the keg in its entirety, but enables beverage dispensing from the keg without removing the keg from its insulated environment. At the same time, the cooler bag with the keg in place is comfortably portable while optionally enabling added ice to be accommodated in and about the keg when desired.

The foregoing is achieved in the manner of the invention by means of a cylindrically shaped soft sided insulating bag-like cooler providing a total enclosure and sized to internally accommodate a beverage keg. A circumferential zipper extending substantially about one end separates the body from a lid which can be opened for compartment access enabling a keg to be inserted or removed. A second more or less radial zipper centrally located within the lid enables a dispensing tap to be connected to the keg for extension outwardly exterior to the bag. The exterior or facing of the bag is of a tough, pliable composition that has been stitched at selected seam locations while the interior includes a similar composition along with an impervious heat welded watertight liner for containment of ice and resulting water. Between the facing layers there is provided a predetermined thickness of soft thermal insulation while a more firm insulation is added at the bottom end. Heavy duty straps including plastic sleeve-like handles extend from an area below the lid through strap loops secured about the exterior of the body to across and under the bottom end so as to enable the bag with keg in place to be conveniently hand carried.

The above noted features and advantages of the invention as well as other superior aspects thereof will be further appreciated by those skilled in the art upon reading the detailed description which follows in conjunction with the drawings.

DESCRIPTION OF THE PREFERRED EMBODIMENT

Figure 1:
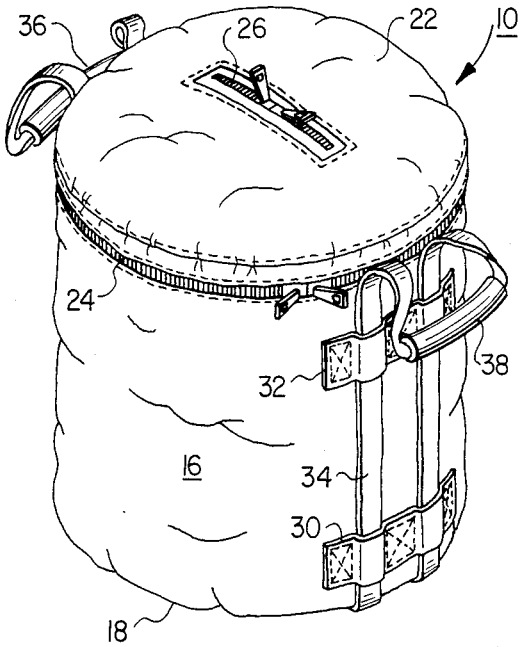
FIG. 1 is an isometric elevation of the keg cooler of the invention.

In the description which follows, like parts are marked throughout the specification and in the drawings with the same reference numerals respectively. Drawing figures are not necessarily to scale and, in certain views, parts may be drawn rotated into the plane of the drawing for purposes of clarity.

Referring now to the drawings, there is illustrated the thermally insulated cooler hereof generally designated 10. The cooler is formed in a cylindrical configuration defining a cylndrical internal compartment 12 in which to receive a beverage keg 14. The keg 14 for purposes hereof will be regarded as prechilled containing a suitable beverage such as soft drink, lemonade, beer, etc. to be dispensed.

Figure 2:
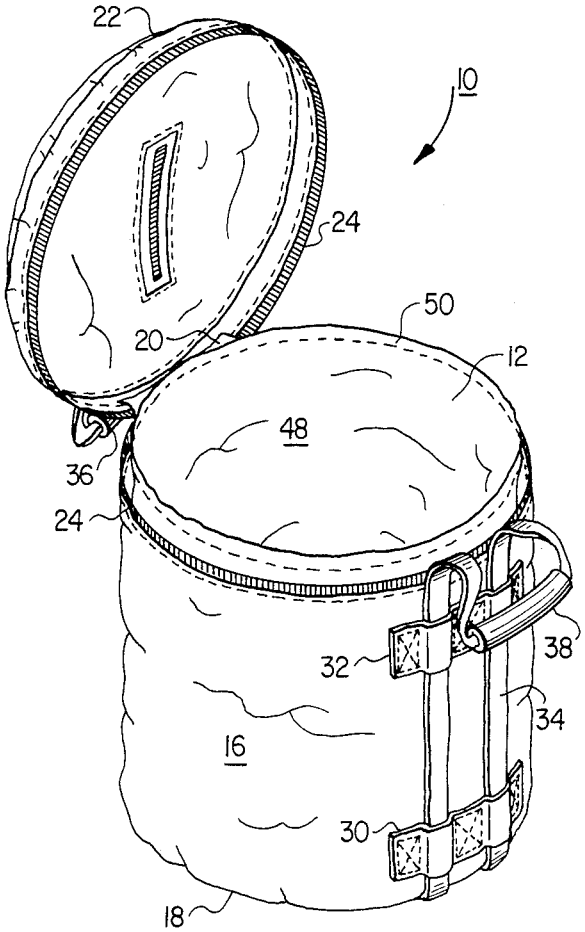
FIG. 2 is an isometric view of the cooler of FIG. 1 in its open relation.
Figure 3:
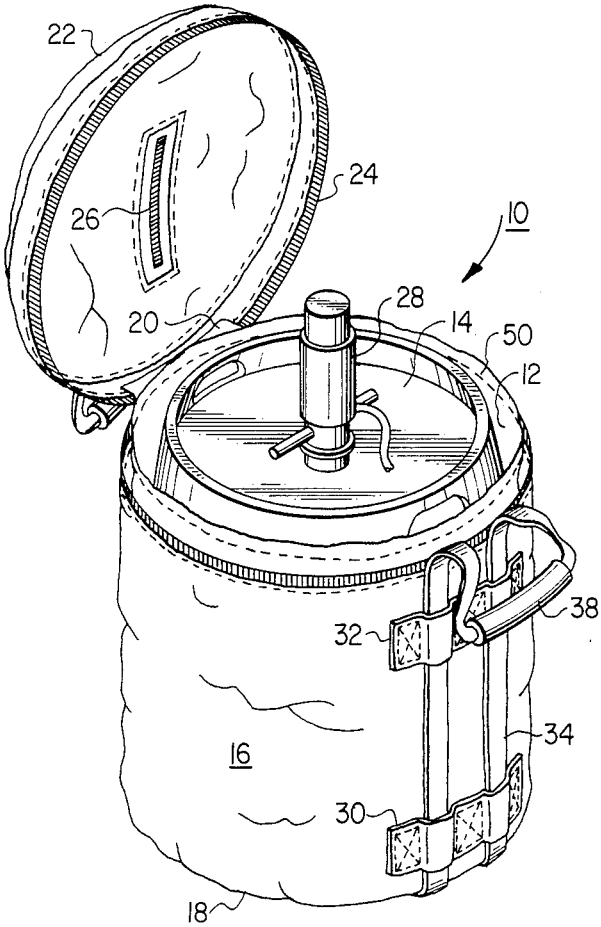
FIG. 3 is an isometric view similar to FIG. 2 with an emplaced keg ready for dispensing.
Figure 4:
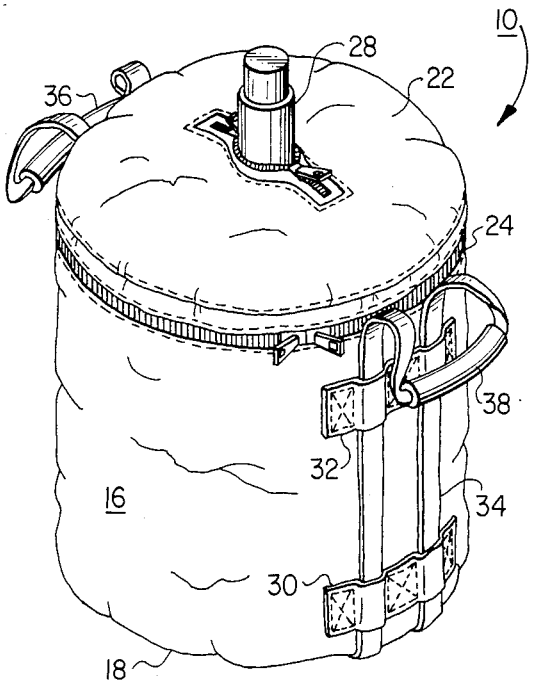
FIG. 4 is an isometric view similar to FIG. 1 with an emplaced key ready for dispensing.

Comprising the cylindrical cooler 10, is an annular body section 16 having an integral and sealed bottom end 18 and containing a flap 20 for supporting a removable or detachable lid 22. For securing the lid to the body there is provided a circumferential zipper 24 whereby the keg can be completely enclosed in a manner of FIG. 1 or opened for access to compartment 12 in the manner of FIG. 2. Radially extending centrally located within the lid 22 is a second zipper 26 which can be maintained closed in the manner of FIG. 1 or partially opened at its center in order to accommodate a tap 28 by which the beverage contents can be dispensed as appropriate. Formed on opposite sides of the body 16 and stitched thereto are strap loops 30 and 32 through which an endless continuous strap 34 extends from handles 36 and 38 across and underneath in a support relation to the bottom 18. In the preferred embodiment, strap 34 is comprised of 1½" width polyester webbing while handles 36 and 38 comprise elongated plastic sleeves providing a comfortable hand grip.

Figure 5:
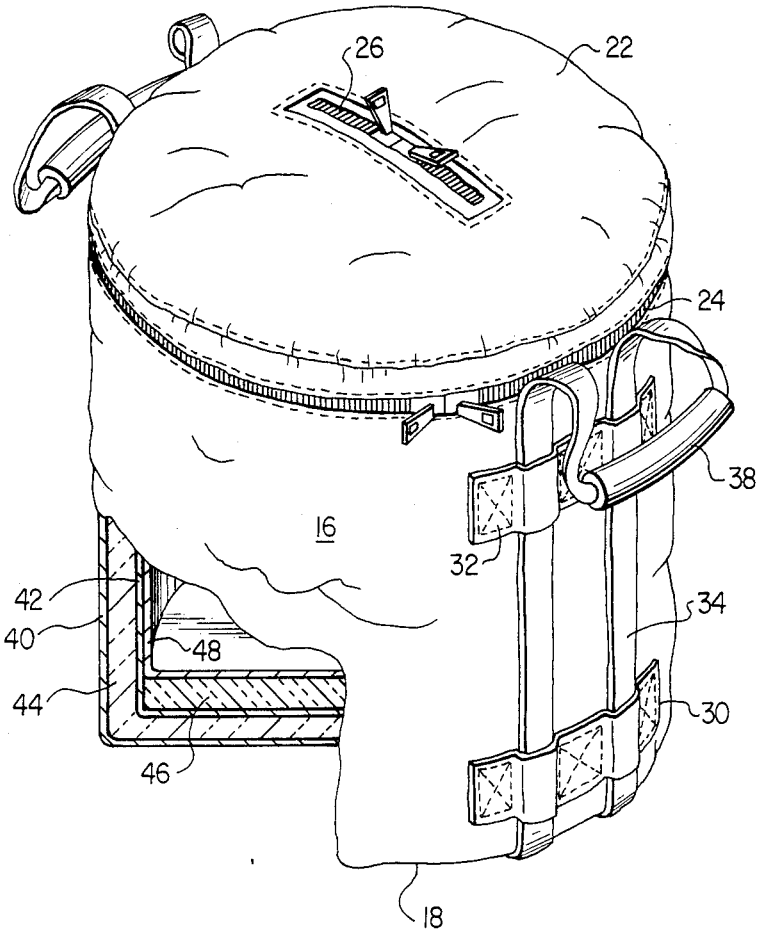
FIG. 5 is a partially sectioned isometric view similar to FIG. 1.

Forming the body 16 and lid 22 are spaced apart exterior cover 40 and an interior cover 42 (FIG. 5) both of which are comprised of a flexible, tough composition of synthetic material which have been stitched at various seams into the relationship shown. In the preferred embodiment hereof, both the outer cover 40 and inner cover 42 are of a 1000 denier polyester reinforced vinyl that promotes high level durability and long life expectancy for the contemplated use able to withstand the sort of scuffing normally encountered in devices of this type. Between the covers 40 and 42 throughout there is provided a heavy weight 20 ounce polyester thermal insulation available for example under the trademark Holofill and characterize as being flexible and generally formfit therein. Internally overlying the covers over bottom 18 is an added circular disc of thermal insulation 46 of a more rigid composition able to support the weight of a beverage filled keg 14. In a preferred embodiment, disc 46 is comprised of a one inch thick medium density closed cell foamboard available under the trademark Ethiform.

Further included within the compartment 12 is a more or less formfit liner 48 of heat sealed water impervious composition in order to contain ice and water as would customarily be provided and ultimately formed therein respectively. The composition of liner 48 is selected for toughness properties able to withstand susceptibility to tearing that could otherwise be encountered from movement or a sharp edge of keg 14 in compartment 12. To render the liner 48 a permanent element of cooler 10, it is attached by stitching along a seam 50. Lid 22 is constructed similarly with a flexible thermal insulation 44 being contained between interior and exterior covers therefor.

It will be appreciated from the description above that cooler 10 by cooperation of body 16 and lid 22 not only provides a completely enclosed thermal jacket about a keg 14 received in compartment 12, but also enables comfortable hand transport of the keg in its thermally insulated relation. By affording a selective opening via zipper 26, on site dispensing of the beverage contents of keg 14 can be readily achieved without the necessity of exposing the keg or its contents to the temperature of the ambient surroundings. Moreover, being that the cooler is comprised of soft compositions, it lends itself to collapse for convenience of storage when not in use. In the above manner, the cooler hereof satisfies a long-felt need in being able to maintain a chilled beverage temperature in keg container for long time periods without refrigeration. While it thereby decreases the need for ice that might otherwise be required to fulfill the time period expectations, it is readily able to accomodate ice where the anticipated time duration of the chill temperature is to be extended. Use of the cooler hereof is not only applicable to beverages in general, but is particularly advantageous in respect to dispensing of draft beer at outdoor events and in remote locations. Not only does such a cooler construction afford the possibility of dispensing the draft beer which is considerably less expensive than cans or bottles, but it likewise enables potential spoilage thereof to be prevented over long periods of time. The distinct advantages afforded thereby should be readily evident.

Since many changes could be made in the above construction and many apparently widely different embodiments of this invention could be made without departing from the scope thereof, it is intended that all matter contained in the drawings and specification shall be intepreted as illustrative and not in a limiting sense.

What is claimed is:

1. A thermally insulated portable cooler for carrying and storing a beverage keg having a dispensing tap projecting outwardly therefrom, said cooler comprising:

a hollow cylindrical flexible outer cover member having an open top end portion, a cylindrical side wall portion, and a circular bottom wall;

a hollow cylindrical flexible inner cover member adapted to coaxially receive the beverage keg, said inner cover member having an open top end portion, a cylindrical side wall portion, and a circular bottom wall, said inner cover member being coaxially received within said outer cover member with said top end portion of said inner cover member being circumferentially secured to said open top end portion of said outer cover member, said bottom wall and said sidewall portion of said inner cover member being respectively spaced inwardly from said bottom wall and side wall portion of said outer cover member and defining therewith an internal cavity having a hollow cylindrical side portion coaxial with said outer and inner cover member, and a lower end portion positioned between said bottom walls;

relatively flexible thermal insulating material operatively disposed within said side portion of said internal cavity;

a generally disc-shaped support member coaxially positioned in said lower end portion of said internal cavity, said support member being formed from a relatively rigid thermal insulating material and adapted to support the bottom end of a beverage keg or the like operatively received in said inner cover member;

carrying strap means, firmly secured to the outer surface of said outer cover member, for facilitating lifting and carrying of said cooler and the beverage keg disposed therein, said carrying strap means having outer end portions extending upwardly along radially opposite portions of said sidewall portion of said outer cover member, and a longitudinally central portion extending generally diametrically across said bottom wall of said outer cover member, the opposite outer ends of said carrying strap means having handle means operatively associated therewith and adapted to be grasped and lifted by a person carrying said cooler and the beverage keg disposed therein, the lifting force on said handle means being transmitted to the bottom end of the keg through said relatively rigid support member via said longitudinally central portion of said carrying strap means;

thermally insulated lid means movably secured to said top end portion for selectively opening and closing the same;

fastening means for releasably holding said lid means in a closed position; and means for defining a closable opening in said cooler through which the dispensing top of the keg may outwardly project.

2. The cooler of claim 1 wherein:

said support member is positioned against said bottom wall of said inner cover member and said relatively flexible thermal insulating material extends beneath said support member within said internal cavity.

3. The cooler of claim 1 wherein:

said fastening means include cooperating zipper means extending around peripheral portions of said insulated lid means and an upper end portion of said outer cover member.

4. The cooler of claim 1 further comprising:

a flexible, waterproof liner member secured within said inner cover member and adapted to receive the beverage keg.

5. The cooler of claim 1 wherein:

the dispensing tap is positioned on the upper end of the keg, and said means for defining a closable opening are disposed on an upper side surface portion of said insulated lid means.

* * * * *